US006545565B1

(12) United States Patent
Atokawa

(10) Patent No.: US 6,545,565 B1
(45) Date of Patent: Apr. 8, 2003

(54) FILTER, ANTENNA SHARING DEVICE, AND COMMUNICATION DEVICE

(75) Inventor: Masayuki Atokawa, Kanazawa (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/670,206

(22) Filed: Sep. 25, 2000

(30) Foreign Application Priority Data

Sep. 24, 1999 (JP) ..... 11-270983

(51) Int. Cl.[7] ..... H01P 1/20; H01P 1/213; H01P 1/202

(52) U.S. Cl. ..... 333/134; 333/202; 333/207; 361/330

(58) Field of Search ..... 333/206, 202, 333/207, 134; 361/330

(56) References Cited

U.S. PATENT DOCUMENTS 5,726,608 A * 3/1998 Arlin ..... 331/117 D

FOREIGN PATENT DOCUMENTS

JP 11046102 A * 2/1999

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP

(57) ABSTRACT

In a band elimination filter, a trap capacitor and a frequency control capacitor are made by using a simple capacitor plate individually provided for each respective resonance circuit.

11 Claims, 7 Drawing Sheets

FILTER, ANTENNA SHARING DEVICE, AND COMMUNICATION DEVICE

BACKGROUND OF THE INVENTION

1. Field of the Invention

The present invention relates to a filter, an antenna sharing device, and a communication device which are operable, e.g., in a microwave band.

2. Description of the Related Art

FIG. 9 shows an example of a conventional circuit configuration for a band elimination filter. The band elimination filter 1 comprises two resonance circuit stages coupled together, and includes resonators 2 and 3 electrically connected in series with trap capacitors C1 and C2, respectively. Capacitors C3 and C4 electrically connected in parallel to the resonators 2 and 3 control the resonance frequencies of the resonators 2 and 3, respectively.

A resonance circuit comprising the resonator 2, the trap capacitor C1, and the frequency control capacitor C3 is electrically connected via a coupling coil L1 to a resonance circuit comprising the resonator 3, the trap capacitor C2, and the frequency control capacitor C4. Furthermore, capacitors C5 and C6 are electrically connected in parallel to these two resonance circuits, respectively. In FIG. 9, reference numerals 5 and 6 designate input and output terminals 5 and 6, respectively.

FIG. 10 shows an example in which the conventional circuit configuration of FIG. 9 is realized on a circuit substrate 20. The resonators 2 and 3 are $\lambda/4$ coaxial dielectric resonators. The coupling coil L1 is formed by winding as shown. The capacitors C5 and C6 are monolithic chip capacitors.

The trap capacitors C1 and C2 and the frequency control capacitors C3 and C4 are formed with one coupling plate 11 as shown in FIG. 11. The coupling plate 11 comprises a dielectric substrate 12 and capacitor electrodes 13 to 18 formed on the front and back surfaces of the dielectric substrate 12. The capacitor electrodes 13 and 16 form the trap capacitor C1. The capacitor electrodes 14 and 17 form the trap capacitor C2. The capacitor electrodes 13 and 15 form the frequency control capacitor C3. The capacitor electrodes 14 and 18 form the frequency control capacitor C4.

Individual monolithic chip capacitors can also be used, as the trap capacitors C1 and C2, and the frequency control capacitors C3 and C4. However, in this case, variations in capacitance between the capacitors C1 to C4 are large, causing the characteristics of the filter 1 to vary considerably, as compared with capacitance-variations between the capacitors formed with the coupling plate 11.

The open end-faces of the dielectric resonators 2 and 3 are connected to the capacitor electrodes 13 and 14 of the coupling plate 11 via conductors 10, respectively. That is, the resonators 2 and 3 are electrically connected to the capacitors C1 and C3 and the capacitors C2 and C4.

As the design frequency of the filter 1 becomes higher, the required capacitances of the capacitors C1 to C4 are decreased. For example, for the filter 1 to be used in the 800 MHZ band, the capacitances of the capacitors C1 to C4 are set at 1.5 to 3.0 pF. On the other hand, for the filter 1 to be used in the 1.5 GHz band which is a quasi-microwave band, the capacitances of the capacitors C1 to C4 are set at 1.0 pF or lower.

In the case in which the capacitors C1 to C4 are formed with the coupling plate 11, an unnecessary capacitance Cs is generated between the capacitor electrodes 13 and 16, and the capacitor electrodes 14 and 17. When the filter 1 is used in the 800 MHZ band, the unnecessary capacitance Cs is very small as compared with the capacitances of the capacitors C1 to C4, and exerts no influence over filter characteristics.

However, when the employed frequency of the filter 1 becomes high, the required capacitances of the capacitors C1 to C4 decrease. Therefore, the unnecessary capacitance Cs considerably affects the filter characteristics. In the case of the band-block filter 1, an unnecessary coupling is caused between the resonance circuits. Thus, there arises the problem that the attenuation characteristics of the filter deteriorate and so forth.

SUMMARY OF THE INVENTION

Accordingly, it is an object of the present invention to provide a filter, an antenna sharing device, and a communication device in which generation of an unnecessary capacitance between resonance circuits is suppressed.

To achieve the above object, according to the present invention, there is provided a filter which comprises plural resonance circuits each having a resonator, a trap capacitor, and a frequency control capacitor electrically connected to the resonator, respectively, the trap capacitor and the frequency control capacitor for each respective resonance circuit being made up of one corresponding capacitor plate. Preferably, a voltage-controllable reactance element such as a PIN diode, a field-effect transistor, a variable capacitance diode, or the like is electrically connected between each of the frequency control capacitors and ground.

The trap capacitor and the frequency control capacitor for each reactive resonance circuit are made up of one capacitor plate. Thereby, an unnecessary capacitance between the resonance circuits can be suppressed, which prevents the resonance circuits from being coupled.

The antenna sharing device and the communication device of the present invention include the filter having the above-described characteristics. Therefore, coupling can be suppressed between the resonance circuits, which provides excellent frequency characteristics.

Other features and advantages of the invention will be understood from the following description of embodiments thereof.

DESCRIPTION OF EMBODIMENTS OF THE INVENTION

Hereinafter, embodiments of the filter, the antenna sharing device, and the communication device of the present invention will be described with reference to the accompanying drawings.

First Embodiment

Figure 1:
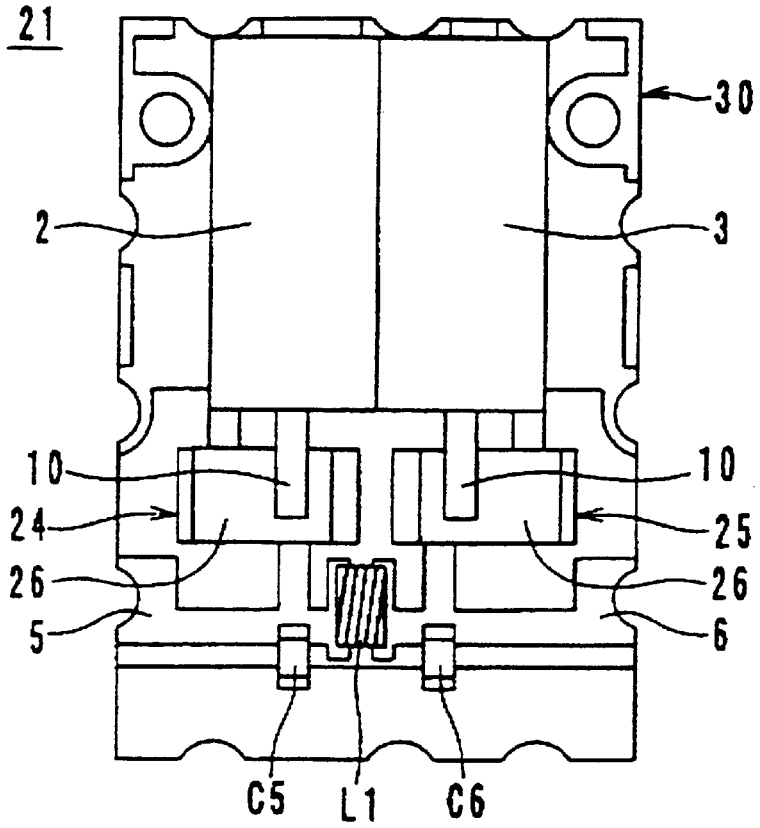
FIG. 1 is a plan view showing the mounting structure of a filter according to an embodiment of the present invention.
Figure 9:
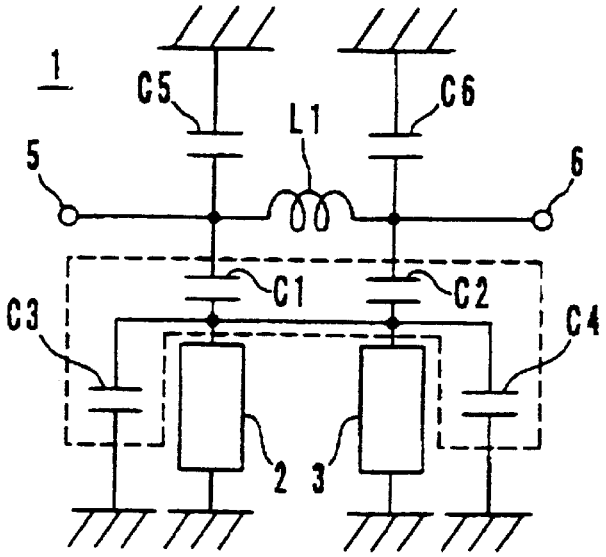
FIG. 9 PRIOR ART
FIG. 9 is a schematic circuit diagram of an example of a conventional filter.
Figure 10:
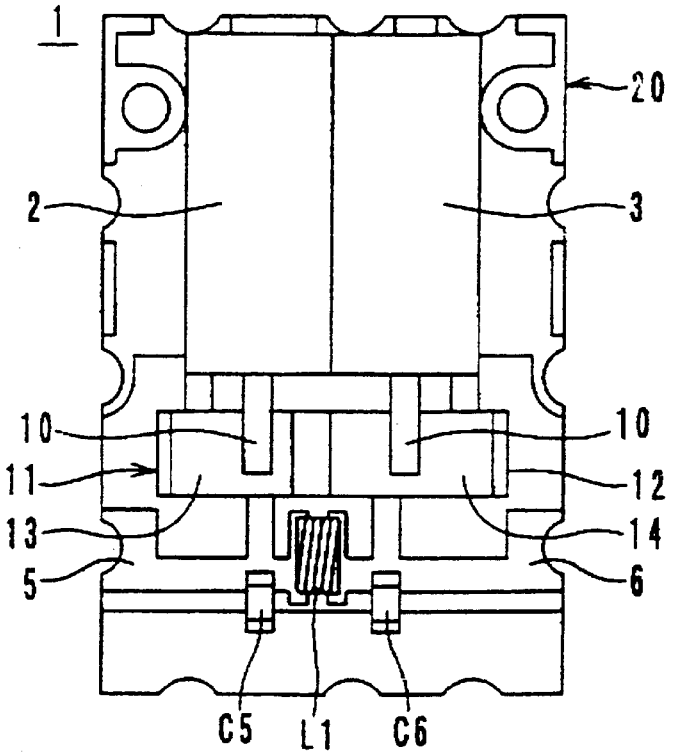
FIG. 10 PRIOR ART
FIG. 10 is a plan view showing the conventional mounting structure of the filter of FIG. 9.
Figure 11:
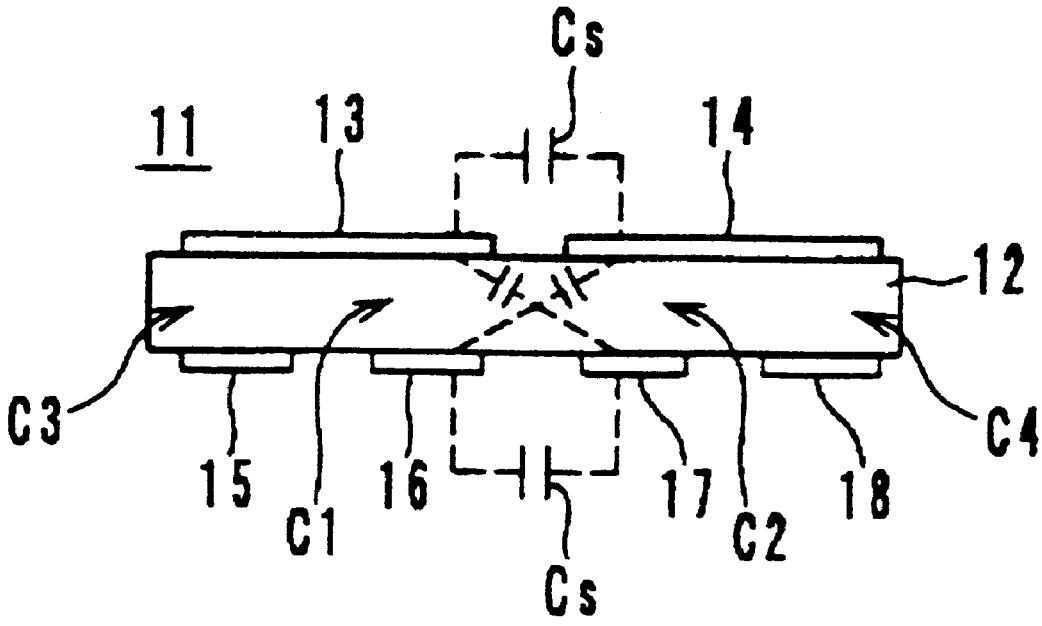
FIG. 11 PRIOR ART
FIG. 11 is a front view of the coupling plate shown in FIG. 10.

FIG. 1 is a plan view of a band elimination filter 21 having the same circuit configuration as shown in FIG. 9, having each of the components mounted on a circuit substrate 30.

As the resonators 2 and 3, $\lambda/4$ coaxial dielectric resonators are used. As the coupling coil L1, a winding coil is employed. As the capacitors C5 and C6, monolithic chip capacitors are used, respectively.

Figure 2:
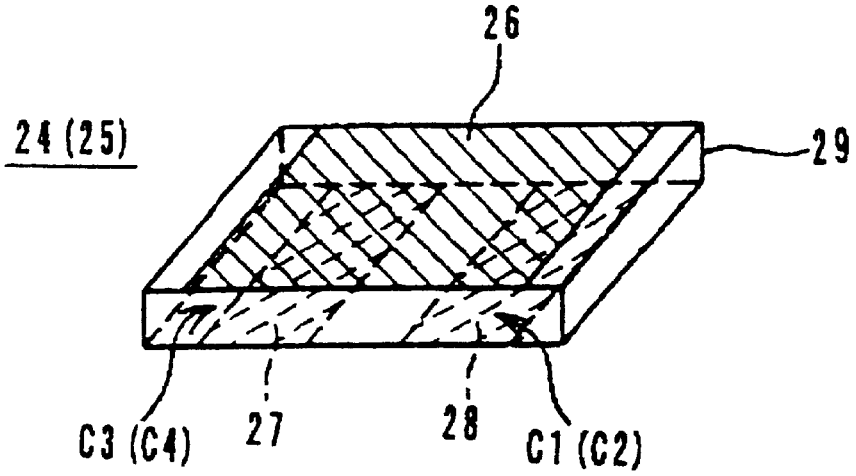
FIG. 2 is a perspective view of a capacitor plate.

One capacitor plate 24 is used to form the trap capacitor C1 and the frequency control capacitor C3. The capacitor plate 24 comprises capacitor electrodes 26 to 28 formed on the front and back surfaces of a dielectric substrate 29, as shown in FIG. 2. The capacitor electrodes 26 and 28 form the trap capacitor C1. The capacitor electrodes 26 and 27 form the frequency control capacitor C3. Another capacitor plate 25 is used to form the trap capacitor C2 and the frequency control capacitor C4. The capacitor plate 25 has the same configuration as that of the capacitor plate 24 of FIG. 2.

The open-circuited end of the dielectric resonator 2 is connected to the capacitor electrode 26 of the capacitor plate 24 via the conductor 10, that is, it is electrically connected to the capacitors C1 and C3. Furthermore, the open-circuited end of the dielectric resonator 3 is connected to the capacitor electrode 26 of the capacitor plate 25, that is, it is connected to the capacitors C2 and C4.

In the band elimination filter 21 configured as described above, the capacitor plates 24 and 25, individually provided for the respective resonance circuits, form the trap capacitors C1 and C2, and the frequency control capacitors C3 and C4. Accordingly, an unnecessary capacitance between the resonance circuits can be suppressed. As a result, the band elimination filter 21 in which coupling is suppressed between the resonance circuits can be provided.

Second Embodiment

Figure 3:
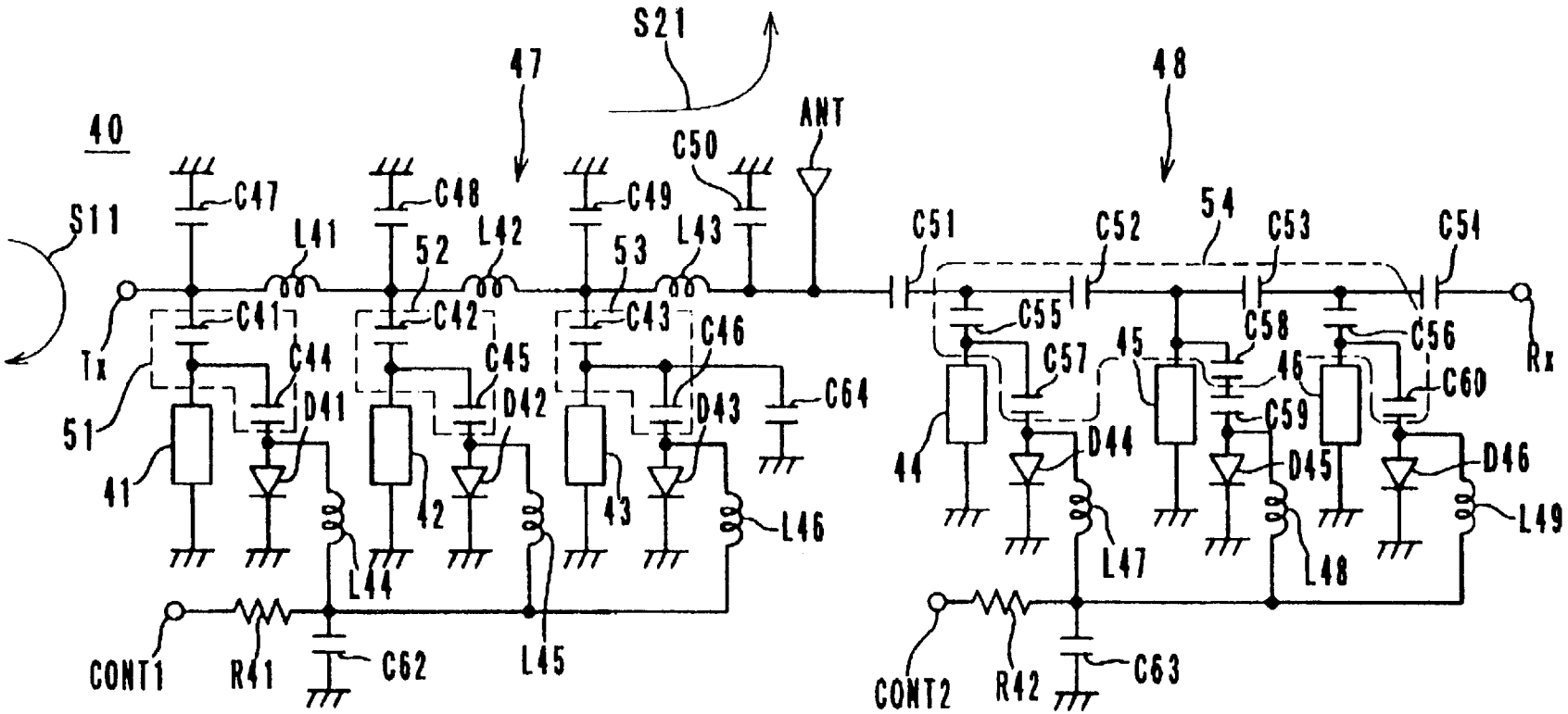
FIG. 3 is a schematic circuit diagram of an antenna sharing device according to an embodiment of the present invention.
Figure 4:
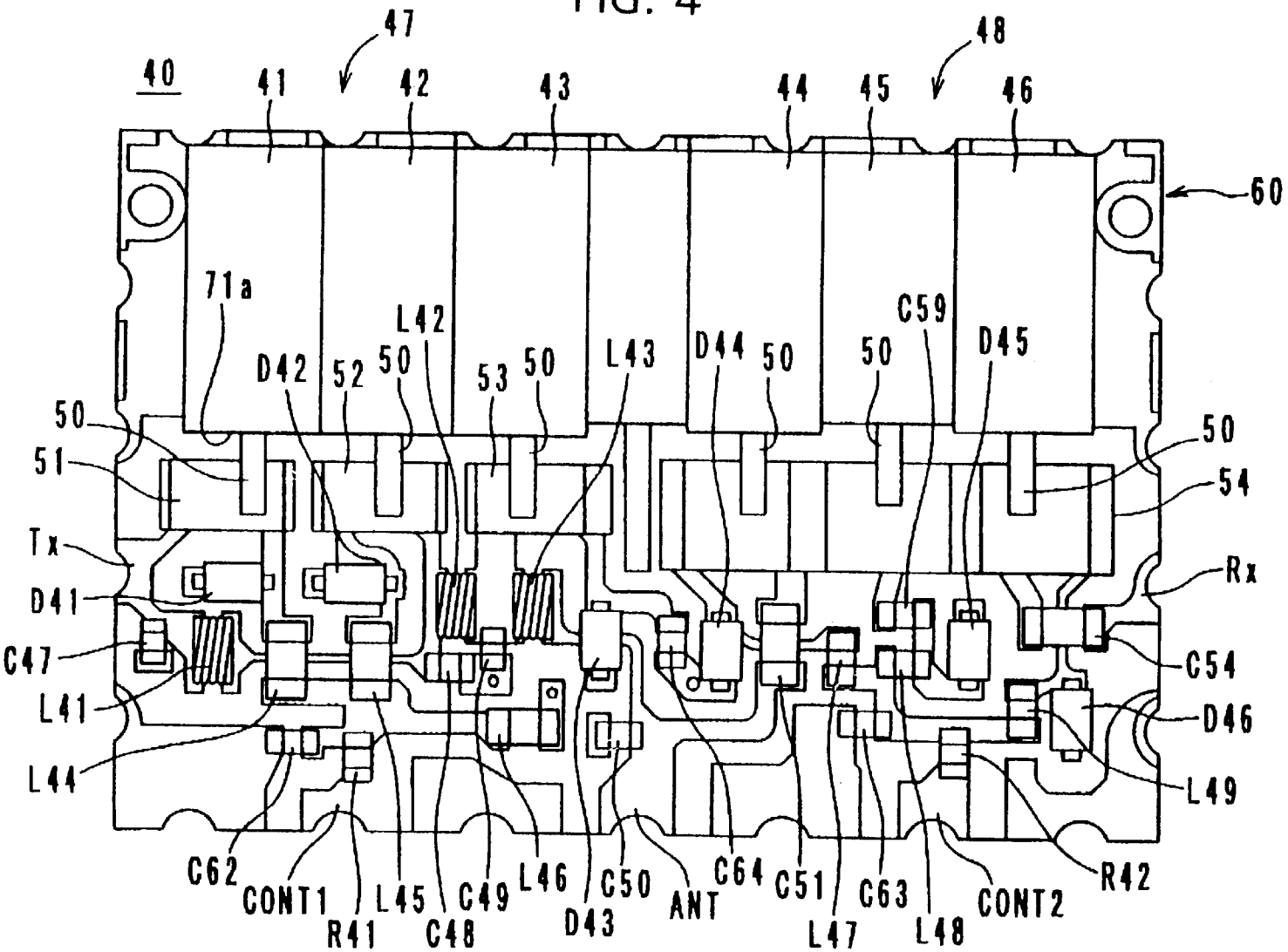
FIG. 4 is a plan view showing the mounting structure of the antenna sharing device of FIG. 3.

FIG. 3 shows the circuit configuration of an antenna sharing device 40. FIG. 4 is a plan view of the antenna sharing device 40 having components mounted on a circuit substrate 60. In the antenna sharing device 40, a transmission side circuit 47 is electrically connected between a transmission terminal Tx and an antenna terminal ANT, while an reception side circuit 48 is electrically connected to a reception terminal Rx and an antenna terminal ANT.

The transmission side circuit 47 constitutes a variable-frequency band elimination filter in which three stages of resonance circuits are coupled to each other. A trap capacitor C41 is electrically connected in series with a resonator 41, and a frequency control capacitor C44 is electrically connected in parallel to the resonator 41. A trap capacitor C42 is electrically connected in series with a resonator 42, and a frequency control capacitor C45 is electrically connected in parallel to the resonator 42. A trap capacitor C43 is electrically connected in series with a resonator 43, and a frequency control capacitor C46 is electrically connected to the resonator 43.

The resonance circuit comprising the resonator 41, and the capacitors C41 and C44, the resonance circuit comprising the resonator 42, and the capacitors C42 and C45, and the resonance circuit comprising the resonator 43, and the capacitors C43 and C46 are electrically connected to each other via coupling coils L41 and L42. Capacitors C47, C48, and C49 are electrically connected in parallel to these three resonator circuits, respectively. The antenna terminal ANT is electrically connected to the resonance circuit comprising the resonator 43, and the capacitor C43 and C46 via an L type LC circuit comprising a coupling coil L43 and a capacitor C50. The trap capacitors C41 to C43 determine the degree of attenuation in a stop-band, respectively.

To an intermediate node between the resonator 41 and the trap capacitor C41, a PIN diode D41, which is a reactance element, is electrically connected via the frequency control capacitor C44 with the cathode being grounded. To an intermediate node between the resonator 42 and the trap capacitor C42, a PIN diode D42, which is a reactance element, is electrically connected via the frequency control capacitor C45 with the cathode being grounded. Moreover, to an intermediate node between the resonator 43 and the trap capacitor C43, a PIN diode D43, which is a reactance element, is electrically connected via the frequency control capacitor C46 with the cathode being grounded. The frequency control capacitors C44 to C46 change the two extreme attenuation frequencies of the attenuation characteristic of the transmission side circuit 47. A capacitor C64 is connected in parallel to the frequency control capacitor C46.

The reception side circuit 48 constitutes a variable frequency band-pass filter in which three stages of resonance circuits are coupled to each other.

A resonance capacitor C55 is electrically connected in series with a resonator 44, and a frequency control capacitor C57 is electrically connected in parallel to the resonator 44. Frequency control capacitors C58 and 59 are electrically connected in parallel to a resonator 45. A resonance capacitor C56 is electrically connected in series with a resonator 46, and a frequency control capacitor C60 is electrically connected to the resonator 46.

The resonance circuit comprising the resonator 44 and the capacitors C55 and C57, the resonance circuit comprising the resonator 45, and the capacitors C58 and C59, and the resonance circuit comprising the resonator 46, and the capacitors C56 and C60 are electrically connected to each other via coupling capacitors C52 and C53. The resonance circuit comprising the resonator 44 and the capacitors C55 and C57 is electrically connected to the antenna terminal ANT via a coupling capacitor C51. The resonance circuit comprising the resonator 46 and the capacitors C56 and C60 is electrically connected to a reception terminal Rx via the coupling capacitor C54.

To an intermediate node between the resonator 44 and the resonance capacitor C55, the series circuit comprising the frequency control C57 and the PIN diode D44 is connected so as to be in parallel to the resonator 44. To an intermediate node among the resonator 45, and the frequency control capacitors C52 and C53, the series circuit comprising the frequency control capacitors C58 and C59, and the PIN diode D45 is electrically connected so as to be in parallel to the resonator 45. To an intermediate node between the resonator 46 and the resonance capacitor C56, the series circuit comprising the frequency control capacitor C60 and the PIN diode D46 is electrically connected so as to be in parallel to the resonator 46.

A voltage control terminal CONT1 is electrically connected to an intermediate node between the anode of the PIN diode D41 and the frequency control capacitor C44 via a control voltage supply resistor R41, a capacitor C62, and a choke coil L44; is electrically connected to an intermediate node between the anode of the PIN diode D42 and the frequency control capacitor C45 via the control voltage supply resistor R41, the capacitor C62, and a choke coil L45; and is electrically connected to an intermediate node between the anode of the PIN diode D43 and the frequency control capacitor C46 via the control voltage supply resistor R41, the capacitor C62, and a choke coil L46.

A voltage control terminal CONT2 is electrically connected to an intermediate node between the anode of the PIN diode D44 and the frequency control capacitor C57 via a control voltage supply resistor R42, a capacitor C63, and a choke coil L47; is electrically connected to an intermediate node between the anode of the PIN diode D45 and the frequency control capacitor C59 via the control voltage supply resistor R42, the capacitor C63, and a choke coil L48; and further is electrically connected to an intermediate node between the anode of the PIN diode D46 and the frequency control capacitor C60 via the control voltage supply resistor R42, the capacitor C63, and a choke coil L49.

Figure 5:
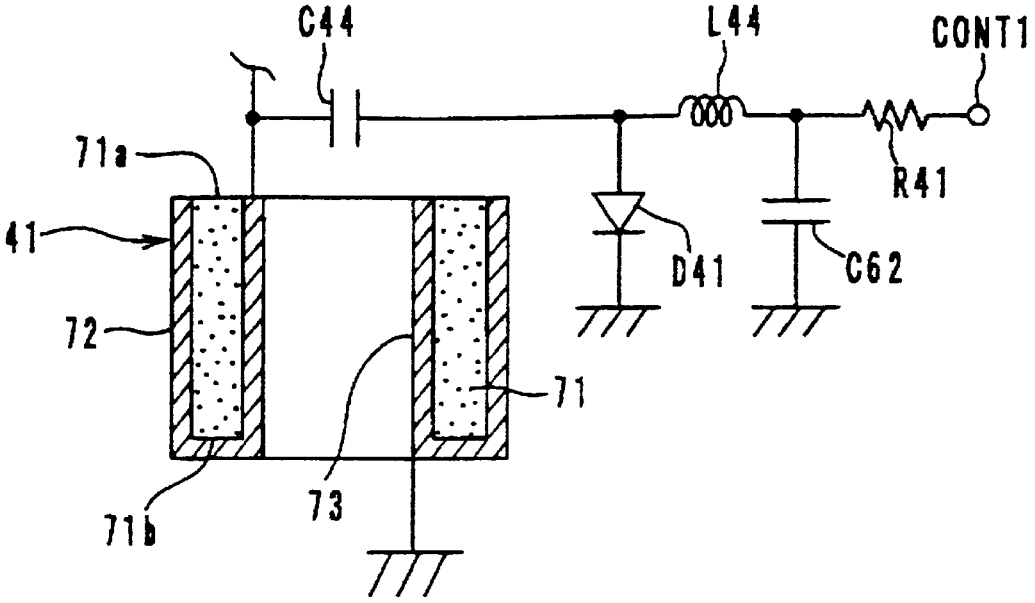
FIG. 5 is a cross sectional view of an example of a resonator.

Dielectric resonators of the type shown in FIG. 5 are used as the resonators 41 to 46. In FIG. 5, the resonator 41 is shown as a typical example. Each of the dielectric resonators 41 to 46 comprises a cylindrical dielectric 71 formed from a material having a high dielectric constant such as $TiO_2$ type ceramics or the like, an outer conductor 72 formed on the outer peripheral surface of the cylindrical dielectric 71, and an inner conductor 73 formed on the inner peripheral surface of the cylindrical dielectric 71. The outer conductor 72 is electrically open-circuited (isolated) from the inner conductor 73 at one of the open end-faces 71*a* of the dielectric 71, and is electrically short-circuited (conductively connected) to the inner conductor 73 at the other end-face 71*b* (hereinafter, referred to as a short-circuit end-face 71*b*).

As the coupling coils L41 to L43, winding type coils are used. As the choke coils L44 to L49, monolithic chip inductors are employed. As the capacitors C47 to C50 and the coupling capacitors C51 and C54, monolithic chip capacitors are used. Furthermore, as the control voltage supply resistors R41 and R42, and the capacitors C62 and C63, chip resistors and monolithic chip capacitors are used, respectively.

One capacitor plate 51 is used to form the trap capacitor C41 and the frequency control capacitor C44 in the transmission side circuit 47. Similarly, a capacitor plate 52 is used to form the trap capacitor C42 and the frequency control capacitor C45. A capacitor plate 53 is used to form the trap capacitor C43 and the frequency control capacitor C46. These capacitor plates 51 to 53 each have the same configuration as that of the capacitor plate 24 shown in FIG. 2.

One coupling plate 54 is used to form the resonance capacitors C55 and C56, the coupling capacitors C52 and C53, and the frequency control capacitors C57, C58, and C60 in the reception side circuit 48. The coupling plate 54 is a well-known type. On the front and back surfaces of the plate 54, plural capacitor electrodes are formed, respectively.

The open end face 71*a* of the dielectric resonator 41 is electrically connected to the capacitors C41 and C44 formed on the capacitor plate 51, via a conductor 50. The open end face 71*a* of the dielectric resonator 42 is electrically connected to the capacitors C42 and C45 formed on the capacitor plate 52 via a conductor 50. Furthermore, the open end face 71*a* of the dielectric resonator 43 is electrically connected to the capacitors C43 and C46 formed on the capacitor plate 53 via a conductor 50.

The open end-faces 71*a* of the dielectric resonators 44 to 46 are electrically connected to the capacitors C55 and C57, the capacitors C52, C53, and C58, and the capacitors C56 and C60 via the conductors 50, respectively.

Hereinafter, the operation of the antenna sharing device 40 configured as described above will be described. In the antenna sharing device 40, a transmission signal from a transmission circuit system input via the transmission terminal Tx is output from the transmission side circuit 47 via the antenna terminal ANT. A reception signal input to the reception side circuit 48 via the antenna terminal ANT is output to a reception circuit system via the reception terminal Rx.

The trap frequency of the transmission side circuit 47 is determined by the resonance frequencies of the resonance circuit comprising the resonator 41, and the capacitors C41 and C44, the resonance circuit comprising the resonator 42, and the capacitors C42 and C45, and the resonance circuit comprising the resonator 43, and the capacitors C43 and C46. When a positive voltage is applied as a control voltage to the voltage control terminal CONT1, the PIN diodes D41 to D43 are turned on. Accordingly, the frequency control capacitors C44 to C46 are grounded via the PIN diodes D41 to D43, so that both of the two extreme attenuation frequencies are decreased, and the pass-band of the transmission side circuit 47 is moved to a LOW channel.

When no voltage is applied to the voltage control terminal CONT1, that is, the respective control voltages become zero, the PIN diodes D41 to D43 are turned off. The PIN diodes D41 to D43 may be turned off by applying a negative voltage to the voltage control terminal CONT1, instead of causing the control voltages to be 0V. Thereby, the frequency control capacitors C44 to C46 are opened, so that both of the two extreme attenuation frequencies are increased, and the pass-band of the transmission side circuit 47 is moved to a HIGH channel. As described above, the transmission side circuit 47 can be provided with two different pass-band characteristics by controlling the voltage so as to ground or open the frequency control capacitors C44 to C46.

The pass frequency of the reception side circuit 48 is determined by the resonance frequencies of the resonance circuit comprising the resonator 44, and the capacitors C55 and C57, the resonance circuit comprising the resonator 45, and the capacitors C58 and C59, and the resonance circuit comprising the resonator 46, and the capacitors C56 and C60. When a positive voltage is applied as a control voltage to the voltage control terminal CONT2, the PIN diodes D44 to D46 are turned on. Accordingly, the frequency control capacitors C57 to C60 are grounded via the PIN diodes D44 to D46, so that the pass frequency is decreased, and the pass-band of the reception side circuit 48 is moved to a LOW channel.

On the contrary, when no voltage is applied to the voltage control terminal CONT2, that is, the control voltages become 0V, the PIN diodes D44 to D46 are turned off. Thereby, the frequency control capacitors C57 to C60 are opened, so that the pass frequency is increased, and the pass-band of the reception side circuit 48 is moved to a HIGH channel. As described above, the reception side circuit 48 can be provided with two different pass-band characteristics by controlling the voltage so as to ground or open the frequency control capacitors C57 to C60.

The antenna sharing device 40 is voltage-controlled to switch between the two pass bands, HIGH and LOW, as follows. When the LOW frequency pass band of the transmission side circuit 47 is selected as the transmission band, the pass frequency of the reception side circuit 48 is reduced; and when the HIGH frequency band is selected as the transmission band, the pass frequency of the reception side circuit 48 is increased. Thereby, phase combination of the transmission side circuit 47 and the reception side circuit 48 can be ideally carried out.

Figure 6:
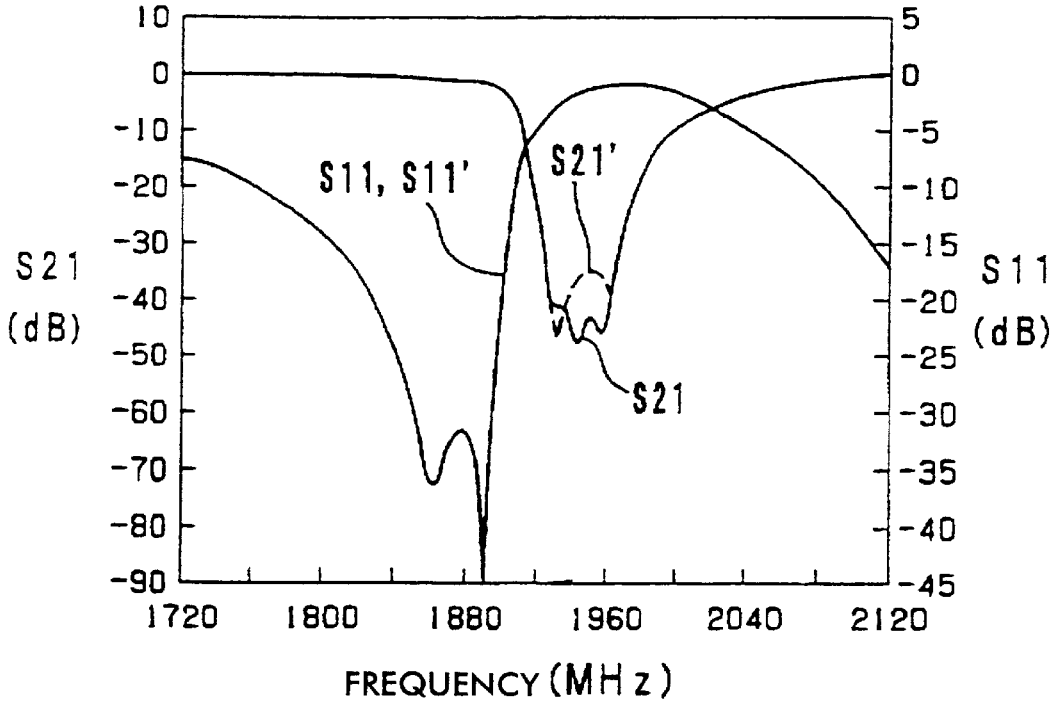
FIG. 6 is a graph showing the pass and reflection characteristics of a transmission side circuit obtained when a positive voltage is applied to voltage control terminals CONT1 and CONT2 in the antenna sharing device of FIG. 3.
Figure 7:
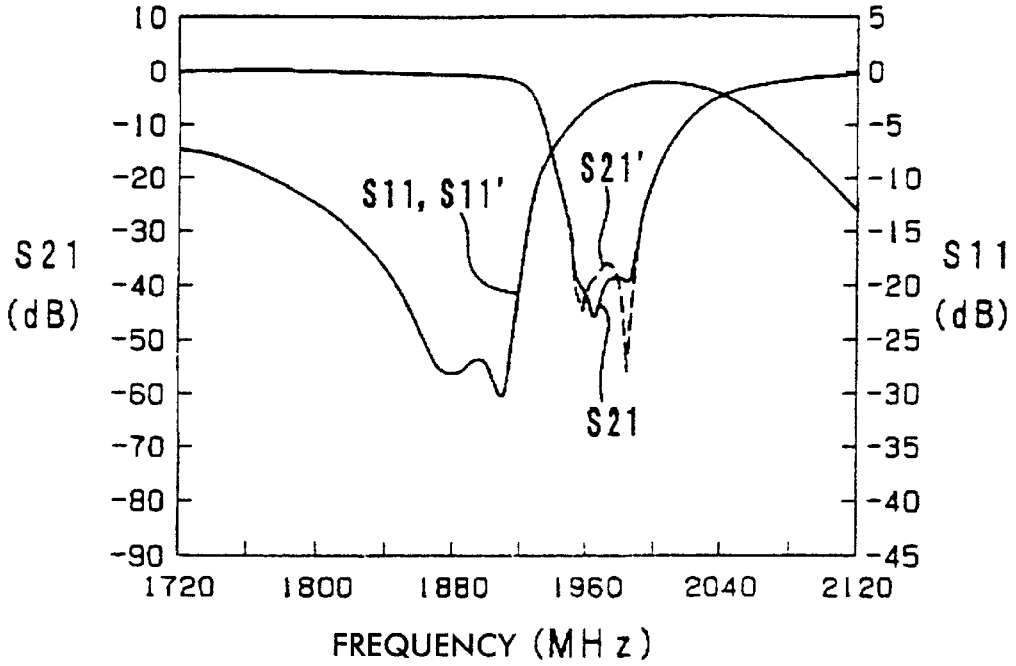
FIG. 7 is a graph showing the pass and reflection characteristics of the transmission side circuit obtained when 0V. is applied to the voltage control terminals CONT1 and CONT2 in the antenna sharing device of FIG. 3.

Moreover, in the transmission side circuit 47 which constitutes a variable frequency type band elimination filter, the trap capacitors C41 to C43 and the frequency control capacitors C44 to C46 are made up of the capacitor plates 51 to 53 individually provided for the respective resonance circuits. Therefore, an unnecessary capacitance can be suppressed between the resonance circuits. As a result, the antenna sharing device 40 can be provided in which coupling of the resonance circuits is prevented. FIG. 6 is a graph showing the pass characteristic S21 and the reflection characteristic S11 of the transmission side circuit 47, which are measurement results obtained when a positive voltage is applied to the voltage control terminals CONT1 and CONT2 of the antenna sharing device 40. FIG. 7 is a graph showing the pass characteristic S21 and the reflection characteristic S11 of the transmission side circuit 47, which are measurement results obtained when 0V is applied to the voltage control terminals CONT1 and CONT2 of the antenna sharing device 40. For comparison, the pass characteristic S21' and the reflection characteristic S11' of the conventional antenna sharing device including a coupling plate in the transmission side circuit thereof are also shown. As seen in FIGS. 6 and 7, the attenuation characteristic of the transmission side circuit 47 is improved.

Third Embodiment

A communication device according to a third embodiment of the present invention will be described by using a portable telephone as an example.

Figure 8:
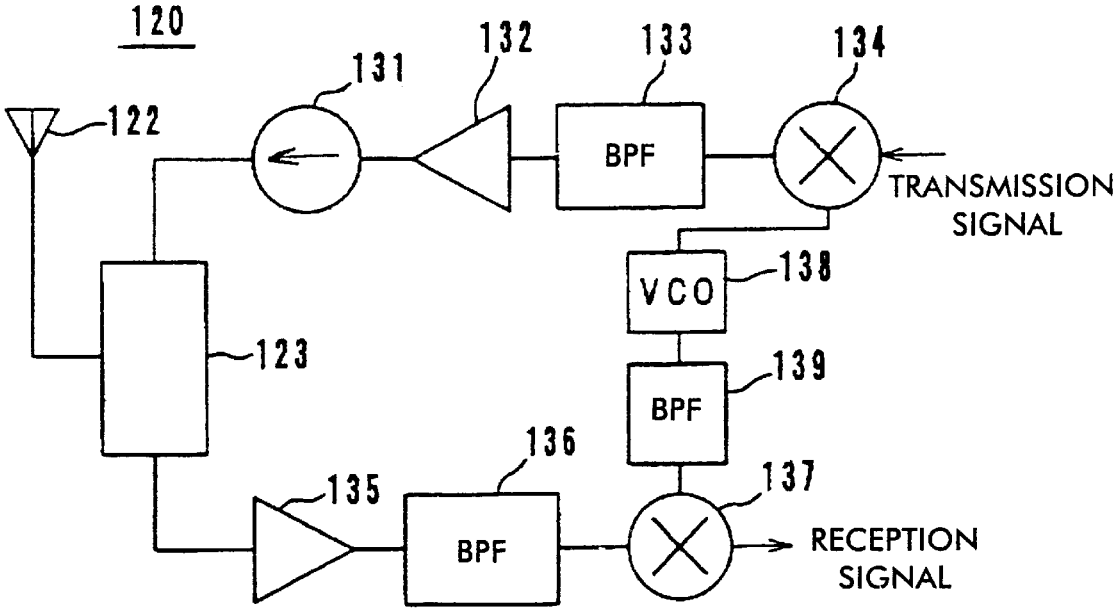
FIG. 8 is a block diagram showing a communication device according to an embodiment of the present invention.

FIG. 8 is an electric circuit block diagram of the RF part of a portable telephone 120 which comprises an antenna element 122, a duplexer 123, a transmission side isolator 131, a transmission side amplifier 132. a transmission side inter-stage band pass filter 133, a transmission side mixer 134, a reception side amplifier 135, a reception-side inter-stage band-pass filter 136, a reception side mixer 137, a voltage control oscillator (VCO) 138, and a local band-pass filter 139.

As the duplexer 123 in the RF part, the antenna sharing device 40 of the second embodiment may be employed. A portable telephone with improved attenuation in the transmission side circuit can be realized by using the antenna sharing device 40.

Other Embodiments

The filter, the antenna sharing device, and the communication device of the present invention are not limited to the above-described embodiments. Various changes and modifications may be made in the invention without departing from the spirit and the scope thereof. Especially, as the reactance elements, variable capacitance diodes, field-effect transistors, or the like may be employed, in addition to the PIN diodes. As the resonators, strip-line resonators or the like may be used.

In the above embodiments, the band elimination filter to which the present invention is applied is described as an example. Needless to say, the present invention may be applied to a band-pass filter provided with resonance circuits having trap capacitors and frequency control capacitors.

As understood from in the above-description, according to the present invention, the trap capacitors and the frequency control capacitors are made up of capacitor plates individually provided for the respective resonance circuits, and therefore, generation of an unnecessary capacitance can be suppressed between the resonance circuits. As a result, a filter, an antenna sharing device, and a communication device each having an excellent frequency characteristic can be provided.

What is claimed is:

1. An antenna sharing device comprising:

a filter comprising a plurality of resonance circuits;

each resonance circuit comprising a respective resonator and a respective capacitor plate;

electrodes being disposed on said capacitor plate and electrically connected to said resonator so as to form a trap capacitor and a frequency control capacitor of said resonance circuit;

a first input/output terminal connected to said filter;

a second filter;

a second input/output terminal connected to said second filter;

a common input/output terminal connected to both said filter and said second filter;

wherein said second filter includes a plurality of resonance circuits, each resonance circuit comprising respectively a resonator, a trap capacitor and a frequency control capacitor; and a common capacitor plate being associated with more than one of said resonance circuits, the respective trap capacitors and frequency control capacitors of said more than one resonance circuit being formed by electrodes disposed on said common capacitor plate.

2. A communication device comprising:

the antenna sharing device according to claim 1;

a first communication circuit connected to said first input/output terminal; and a second communication circuit connected to said second input/output terminal.

3. A communication device according to claim 2, wherein said first communication circuit comprises a transmission circuit.

4. A communication device according to claim 3, wherein said second communication circuit comprises a reception circuit.

5. The antenna sharing device of claim 1, wherein at least one of said filters further comprises a voltage-controllable reactance element electrically connected between the frequency control capacitor and ground.

6. The antenna sharing device of claim 5, wherein the reactance element is a PIN diode.

7. A communication device, comprising:

an antenna sharing device including:

a filter having a plurality of resonance circuits;

each resonance circuit comprising a respective resonator and a respective capacitor plate; and electrodes being disposed on each said capacitor plate and electrically connected to the corresponding said resonator so as to form a trap capacitor and a frequency control capacitor of said resonance circuit;

a first input/output terminal connected to said filter;

a second filter;

a second input/output terminal connected to said second filter;

a common input/output terminal connected to both said filter and said second filter;

a first communication circuit connected to said first input/output terminal; and a second communication circuit connected to said second input/output terminal;

wherein said second filter comprises a plurality of resonance circuits, each resonance circuit comprising respectively a resonator, a trap capacitor and a frequency control capacitor;

a common capacitor plate being associated with more than one of said resonance circuits; and the respective trap capacitors and frequency control capacitors of said more than one resonance circuit being formed by electrodes disposed on said common capacitor plate.

8. The communication device of claim 7, wherein said first communication circuit comprises a transmission circuit.

9. The communication device of claim 7, wherein said second communication circuit comprises a reception circuit.

10. The communication device of claim 7, said filter further comprising a voltage-controllable reactance element, electrically connected between the frequency control capacitor and ground.

11. The communication device of claim 10, wherein the reactance element is a PIN diode.

* * * * *